US007767138B2

(12) United States Patent
Jehanno et al.

(10) Patent No.: US 7,767,138 B2
(45) Date of Patent: Aug. 3, 2010

(54) PROCESS FOR THE PRODUCTION OF A MOLYBDENUM ALLOY

(75) Inventors: Pascal Jehanno, Höfen (AT); Martin Heilmaier, Magdeburg (DE); Heinrich Kestler, Reutte (AT)

(73) Assignee: Plansee SE, Reutte (AT)

( * ) Notice: Subject to any disclaimer, the term of this patent is extended or adjusted under 35 U.S.C. 154(b) by 589 days.

(21) Appl. No.: 11/510,238

(22) Filed: Aug. 25, 2006

(65) Prior Publication Data

US 2006/0285990 A1 Dec. 21, 2006

Related U.S. Application Data

(63) Continuation of application No. PCT/AT2005/000053, filed on Feb. 21, 2005.

(30) Foreign Application Priority Data

Feb. 25, 2004 (AT) ..... GM134/2004

(51) Int. Cl.
*B22F 3/24* (2006.01)

(52) U.S. Cl. ..... 419/28; 419/29; 75/254

(58) Field of Classification Search ..... 148/538, 148/423; 419/28, 29; 75/254
See application file for complete search history.

(56) References Cited

U.S. PATENT DOCUMENTS 5,595,616 A 1/1997 Berczik
5,693,156 A 12/1997 Berczik
5,865,909 A 2/1999 Meyer et al.
6,652,674 B1 11/2003 Woodard et al.

FOREIGN PATENT DOCUMENTS

WO WO 96/22402 7/1996

OTHER PUBLICATIONS

Nieh et al. ("Deformation of a Multiphase Mo-9.4Si-13.8B Alloys at elevated Temperatures", Intermetallics, 9 (2001), 73-79).*
Schneibel, et al.,"Optimization of Mo-Si-B Intermetallics", Oak Ridge National Laboratory, pp. 53 to 58, dated 2003.
Schneibel, "High Temperature Strength of Mo-$Mo_3Si$-$Mo_5SiB_2$ Molybdenum Silicides", Oak Ridge National Laboratory, pp. 625 to 632, dated Jul. 2003.
Nieh, et al., ,,Deformation of a Multiphase Mo-9.4Si-13.8B Alloy at Elevated Temperatures, Larence Livermore National Laboratory, pp. 73 to 79, dated Jan. 2001.

* cited by examiner

*Primary Examiner*—George Wyszomierski
*Assistant Examiner*—Weiping Zhu
(74) *Attorney, Agent, or Firm*—Laurence A. Greenberg; Werner H. Stemer; Ralph E. Locher

(57) ABSTRACT

Semi-finished or finished parts are made from a molybdenum alloy with intermetallic phases, preferably molybdenum-silicide, molybdenum-boron-silicide, optionally also molybdenum-boride phases. Starting from mechanically alloyed powder, hot compacted material exhibits superplastic forming behavior. It is thus possible to lower the forming temperature by at least 300° C., thus permitting processing on conventional plants.

17 Claims, No Drawings

PROCESS FOR THE PRODUCTION OF A MOLYBDENUM ALLOY

CROSS-REFERENCE TO RELATED APPLICATIONS

This is a continuation, under 35 U.S.C. §120, of copending international application No. PCT/AT2005/000053, filed Feb. 21, 2005, which designated the United States; this application also claims the priority, under 35 U.S.C. §119, of Austrian Utility Model GM 134/2004, filed Feb. 25, 2004; the prior applications are herewith incorporated by reference in their entirety.

BACKGROUND OF THE INVENTION

Field of the Invention

The invention relates to a process for the production of semi-finished or finished parts from a molybdenum alloy with intermetallic phases.

Molybdenum and molybdenum alloys are employed in a wide range of technical applications in view of their good mechanical strength properties at high temperatures. One problem of these alloys is their low resistance to oxidation at temperatures above 600° C. Correspondingly varied are the known measures applied for improving the oxidation properties. They range from applying superficial protective layers through to alloying measures. The oxidation resistance can, for example, be improved by the addition of silicon and boron to the alloy, as described in Akinc et al.: Materials Science and Engineering, A261 (1999) 16-23; Meyer et al.: Advanced Materials 8 (1996) 8, and Meyer et al.: J. Am. Ceram. Soc. 79 (1996) 63-66.

U.S. Pat. No. 5,693,156 and its counterpart international publication WO 96/22402 (EP 0 804 627) also describe an oxidation-resistant molybdenum alloy consisting of a molybdenum matrix with dispersed intermetallic phases of 10 to 70 vol.% Mo—B-silicide, optionally up to 20 vol.% Mo boride, and optionally up to 20 vol.% Mo-silicide. Apart from molybdenum, the alloy contains the elements C, Ti, Hf, Zr, W, Re, Al, Cr, V, Nb, Ta, B and Si in such a form that in addition to the above-mentioned phases, one or more elements of the group Ti, Zr, Hf and Al has to be present in a percentage of 0.3 to 10 wt.% in the Mo binary phase.

Alloys according to these prior art disclosures form a boron silicate layer at temperatures above 540° C. that prevents any further penetration of oxygen into the inside of the body. As a result of the Mo matrix, alloys according to these patents exhibit significantly improved ductility.

U.S. Pat. No. 5,595,616 describes a process for the production of a Mo—Si—B alloy with Mo matrix in which intermetallic phase elements are intercalated. The process involves the rapid solidification of a melt, whereby this can be performed by the atomization of a melt. In the further course of the process, the rapidly solidified powder is compressed by hot compacting, whereby this process step has to take place in such a way that no coarsening of the intermetallic phase elements occurs. Semi-finished products manufactured in this way can be further processed by hot forming. A disadvantage of this is that for the purpose of the rapid solidification, the molybdenum alloy has to be melted. In view of the high melting point and the chemical aggressiveness of the melt, however, no crucible material is available for this purpose. Melting therefore has to be performed without a crucible, making this process step very complex. In addition, alloys produced by this process with an optimum silicon and boron content (approx. 4 wt.% Si, approx. 1.5 wt.% B) for their oxidation resistance can no longer be further processed by forming so that a compromise has to be made between oxidation resistance and processability.

SUMMARY OF THE INVENTION

It is accordingly an object of the invention to provide a method of producing a molybdenum alloy which overcomes the above-mentioned disadvantages of the heretofore-known devices and methods of this general type and which enables oxidation-resistant molybdenum-silicon-boron alloys to be produced inexpensively using a forming process.

With the foregoing and other objects in view there is provided, in accordance with the invention, a method of producing semi-finished or finished parts from a molybdenum alloy with intermetallic phases. The method comprises the following steps:

mechanically alloying a powder mixture containing at least 60 wt.% Mo, at least 0.5 wt.% Si and at least 0.2 wt.% B, the powder mixture existing in elementary, partially prealloyed, or fully prealloyed form;

hot compacting (pressure-less, or pressure-aided) the powder mixture at a compacting temperature T, where 1100° C.<T<1900° C.;

superplastic forming at a forming temperature T, where 1000° C.<T<1600° C., and at a forming rate $\dot{\epsilon}$ of $1\times10^{-6}$ $s^{-1}\dot{\epsilon}<10^{0}$ $s^{-5}$; and heat treating at a temperature T, where 1400° C.<T<1900° C.

The process according to the invention involves a high-energy grinding process in which the powder particles employed are mixed in such a way that one can speak of "mechanical alloying". The powder mixture employed here consists of at least 60 wt.% Mo, 0.5 wt.% Si and 0.2 wt.% B. The powder can be present in elementary, in partially prealloyed or in completely prealloyed form. We speak of elementary powder mixtures when the individual particles exist in pure form and the alloy is produced by mixing such powders. A powder particle is completely prealloyed when is consists of a homogeneous alloy. Partially prealloyed powder consists of particles with different concentration ranges. Suitable plants for mechanical alloying are high-energy mills such as for example attrition mills, falling-ball mills or vibratory mills. The grinding times depend here on the mill type employed. The typical process times when using an attrition mill, for example, lie between 0.5 and 48 hours.

In order to prevent oxidation of the alloying components it is necessary to perform the grinding process in a protective gas atmosphere. The use of hydrogen has proved to be particularly suitable here. The mechanically alloyed powder can then be formed in the further course of the process by cold compacting, for example by matrix pressing, cold isostatic pressing, metal powder injection moulding or slip casting. But it is also possible to immediately subject the mechanically alloyed powder to a hot compacting process, such as is the case for example with hot isostatic pressing and powder extrusion. The former has proved to be particularly worthwhile. Here the ground powder is poured into a can made from a molybdenum or titanium alloy, sealed vacuum-tight and compacted at temperatures typically in the range from 1,000° C. to 1,600° C., preferably 1300° C. to 1500° C., and a pressure of typically 10 to 300 MPa, preferably 150 to 250 MPa. Alternatively, sintered material with predominantly closed porosity can also be hot isostatically post-compacted without the can. Conventional sinter-HIP processes, the Ceracon process or the ROC (Rapid Omnidirectional Compacting) process can also be employed.

In addition, pressureless processes such as for example conventional sintering, plasma-aided sintering or microwave sintering are also suitable, whereby in the case of solid-phase sintering temperatures of >1500° C. are required. If alloying components are added that lower the solidus temperature, it is also possible to achieve an adequate density at lower temperatures.

Surprisingly, it has now been discovered that a molybdenum alloy produced in this way can be superplastically formed at temperatures of 1,000° C. to 1,600° C. with forming rates $\dot{\epsilon}$ of $10^{-6}$ $s^{-1}<\dot{\epsilon}<10^{0}$ $s^{-1}$. Suitable forming methods here are both semi-finished product manufacturing processes such as for example rolling or pressing, and also forming processes such as for example forging in a die or deep drawing. With the process according to the invention it is possible to reduce the forming temperature to below 1600° C., thus allowing conventional plants, in particular heating plants such as those used for the production of refractory metals, to be employed.

In order to achieve an adequate creep resistance, however, it is necessary to subject the superplastically formed molybdenum alloy to a further process step, namely a heat treatment at a temperature >1400° C., preferably 1600° C. to 1900° C., preferably in a reducing atmosphere or vacuum. This is documented in the examples.

It is fundamentally also possible to form the molybdenum alloy conventionally in accordance with the prior art before the superplastic forming step. This can be advantageous if an additional structure refinement and homogenisation is desired, as is the case for example when the hot compacting is performed by pressureless sintering.

The process according to the invention has proved to be particularly advantageous when the molybdenum alloy contains 2 to 4 wt.% silicon and 0.5 to 3 wt.% boron. As already stated at the beginning, molybdenum-silicon-boron alloys in this concentration range can only be processed at very high forming temperatures and cannot be further processed by forming methods in the high silicon and boron range. Molybdenum alloys containing 2 to 4 wt.% silicon and 0.5 to 3 wt.% boron contain intermetallic molybdenum-silicide, molybdenum-boron-silicide, optionally also molybdenum-boride phases, and molybdenum or molybdenum mixed crystals. The preferred molybdenum-silicide or molybdenum-boron-silicide phases to be noted here are $Mo_3Si$ and $Mo_5SiB_2$. Using the process according to the invention it is even possible to form alloys that cannot be processed by forming methods from the prior art.

It has furthermore been discovered that by using the process according to the invention, molybdenum-silicon-boron alloys containing 0.5 to 30 wt.% niobium and/or tantalum can be produced that exhibit both higher ductility and higher heat strength values than alloys not containing these alloying components or containing less of these components. This is also explained in greater detail in the examples.

Surprisingly, it has also been discovered that even with the admixture of oxides or mixed oxides with a vapor pressure at 1,500° C. of $<5\times10^{-2}$ bar, the superplastic forming behaviour is not negatively influenced. The adding of oxides or mixed oxides to the alloy improves the heat strength and creep resistance, surprisingly without negatively influencing the ductility of the material. Particularly suitable oxides for this are $Y_20_3$, $Zr0_2$, $Hf0_2$, $Ti0_2$, $Al_2O_3$, CaO, MgO and SrO or their mixed oxides.

If 0.001 to 5 wt.% of one or more metals from the rhenium, titanium, zirconium, hafnium, vanadium, chromium and aluminium group is added to the molybdenum alloy, this promotes the formation of a dense boron-silicate layer.

Other features which are considered as characteristic for the invention are set forth in the appended claims.

Although the invention is illustrated and described herein as embodied in a process for the production of a molybdenum alloy, it is nevertheless not intended to be limited to the details specifically described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when considered in view of the specific examples.

DETAILED DESCRIPTION OF EXEMPLARY EMBODIMENTS

Example 1

The following powders were employed for the production of molybdenum alloy:

Molybdenum with a grain size according to Fisher of 4.1 μm,

Niobium, screened to <32 μm,

Silicon with a grain size according to Fisher of 4.3 μm,

Boron with a grain size according to Fisher of 1.01 μm.

The niobium content was varied while the silicon and boron contents were 3 wt.% and 1 wt.% respectively in each case. The alloy compositions are shown in the following Table 1.

TABLE 1

Composition of the molybdenum-silicon-boron alloys

| | Process | Mo (wt. %) | Nb (wt. %) | Si (wt. %) | B (wt. %) |
|---|---|---|---|---|---|
| Alloy 1 | invention | 93 | 3 | 3 | 1 |
| Alloy 2 | invention | 86 | 10 | 3 | 1 |
| Alloy 3 | invention | 76 | 20 | 3 | 1 |
| Alloy 4 | prior art | 76 | 20 | 3 | 1 |
| Alloy 5 | prior art | 96 | 0 | 3 | 1 |

Alloys 1, 2 and 3 were produced using the process according to the invention, while alloys 4 and 5 were produced using methods from the prior art.

Powder mixtures according to the alloy compositions 1, 2 and 3 were alloyed mechanically in an attrition mill of stainless steel. 100 kg of steel balls with a ball diameter of 9 mm were employed for this. The powder charge volume in each case was 5 kg. Grinding took place under hydrogen. The ground powder was poured into a can made of a molybdenum alloy, sealed vacuum-tight and hot isostatically compacted at a temperature of 1,400° C. and a pressure of 200 MPa for 4 hours. The hot compacted material produced in this way exhibited a pore-free microstructure and a density of >99% of the theoretical density. For comparison, alloys 4 and 5 were produced using the method from the prior art by atomizing sintered rods. The powder was cold isostatically compacted at 200 MPa and then sintered under hydrogen at 1,700° C. for 5 hours. The sintered rods were atomised without the use of a crucible. The powder produced in this way was poured into a titanium can and hot isostatically compacted (1,500° C., 200

MPa, 4 hours). After density of 9.55 g/cm$^2$ was measured, corresponding to 99% of the theoretical density.

Specimens were taken from the semi-finished products manufactured in this way by wire erosion and turning on a lathe. These specimens were formed at a temperature of 1,300° C. with strain rates of $10^{-4}$ s$^{-1}$ and $10^{-3}$ s$^{-1}$. The semi-finished product manufactured in the process according to the invention was found to exhibit superplastic behaviour. Depending on the forming rate and alloy composition, the measured elongations lay between 60.2 and 261.5% (see Table 2). These properties allow superplastic forming at temperatures below 1,500° C., i.e. on conventional plants for the production of refractory metals. A niobium addition of more than 5 wt.% (alloy 2 and alloy 3) results in a significant increase in the strength with a simultaneous increase in the elongation at failure.

TABLE 2

Properties of molybdenum-silicon-boron alloys (alloys 1 to 3) manufactured in the process according to the invention compared with the prior art (alloys 4 and 5)

| Designation | Temperature (° C.) | Strain rate (s$^{-1}$) | Maximum stress (MPa) | Elongation (%) |
|---|---|---|---|---|
| Alloy 1 | 1300 | $10^{-4}$ | 33 | 161.7 |
| | 1300 | $10^{-3}$ | 125 | 60.2 |
| Alloy 2 | 1300 | $10^{-4}$ | 43 | 210.8 |
| | 1300 | $10^{-3}$ | 140 | 76.5 |
| Alloy 3 | 1300 | $10^{-4}$ | 45 | 281.5 |
| | 1300 | $10^{-3}$ | 162 | 95.3 |
| Alloy 4 | 1300 | $10^{-4}$ | 299 | 11.9 |
| | 1300 | $10^{-3}$ | 267 | 0.1 |
| Alloy 5 | 1300 | $10^{-4}$ | 278 | 15.2 |
| | 1300 | $10^{-3}$ | 250 | 0.1 |

Example 2

Molybdenum-silicon-boron-niobium alloys with the compositions shown in Table 1 were again used. After mechanical alloying performed in a 250 liter attrition mill under hydrogen, the materials produced in the process according to the invention were poured into a titanium can, sealed vacuum-tight and compacted hot isostatically at 1,400° C. and 200 MPa. The density was >99% of the theoretical density.

Alloys 4 and 5 were produced as described in Example 1. The semi-finished product manufactured in this way was subjected to heat treatment under vacuum. The temperature during the process was 1,700° C. with a holding time of 5 hours. Tensile strain specimens were produced by wire erosion and turning on a lathe. The tensile tests were performed at a constant strain rate of $10^{-4}$ s$^{-1}$ at three different temperatures. The results are shown in Table 3. Alloy 3, in particular, exhibited a significantly improved high-temperature strength.

TABLE 3

Results of the tensile tests on heat treated molybdenum-silicon-boron alloys (alloys 1 to 3 manufactured in the process according to the invention, compared with the prior art, alloy 4)

| | Temperature (° C.) | Maximum stress (MPa) | Elongation (%) |
|---|---|---|---|
| Alloy 1 | 1200 | 418 | 16.6 |
| | 1300 | 333 | 23.2 |
| | 1400 | 120 | 65.1 |

TABLE 3-continued

Results of the tensile tests on heat treated molybdenum-silicon-boron alloys (alloys 1 to 3 manufactured in the process according to the invention, compared with the prior art, alloy 4)

| | Temperature (° C.) | Maximum stress (MPa) | Elongation (%) |
|---|---|---|---|
| Alloy 2 | 1200 | 445 | 2.1 |
| | 1300 | 358 | 17.6 |
| | 1400 | 153 | 27.1 |
| Alloy 3 | 1200 | 528 | 2.1 |
| | 1300 | 372 | 17.2 |
| | 1400 | 161 | 35.1 |
| Alloy 4 | 1200 | 472 | 3.1 |
| | 1300 | 288 | 15.4 |
| | 1400 | 127 | 23.9 |
| Alloy 5 | 1200 | 424 | 5.1 |
| | 1300 | 267 | 17.1 |
| | 1400 | 108 | 30.3 |

We claim:

1. A method of producing semi-finished or finished parts from a molybdenum alloy with intermetallic phases, the method which comprises the following steps:

mechanically alloying a powder mixture containing at least 60 wt. % Mo, at least 0.5 wt. % Si and at least 0.2 wt. % B in a high-energy grinding mill, the powder mixture existing in elementary, partially prealloyed, or fully prealloyed form;

hot compacting the powder mixture at a compacting temperature T, where 1100° C.<T<1900° C.;

superplastic forming at a forming temperature T, where 1000° C.<T<1600° C., and at a forming rate $\dot{\epsilon}$, where $1\times10^{-6}$ s$^{-1}$≦$\dot{\epsilon}$<$10^{0}$ s$^{-1}$; and heat treating at a temperature T, where 1400° C.<T<1900° C.

2. The method according to claim 1, wherein the Mo alloy contains 2 to 4 wt. % Si and 0.5 to 3 wt. % B.

3. The method according to claim 1, wherein the Mo alloy contains 0.5 to 30 wt. % of at least one of the elements selected from the group consisting of Nb and Ta.

4. The method according to claim 1, wherein the Mo alloy contains one or more oxides or mixed oxides with a vapor pressure at 1500° C. of <$5\times10^{-2}$ bar.

5. The method according to claim 1, wherein the Mo alloy contains at least one oxide or mixed oxide selected from the group of metals consisting of Y, lanthanide, Zr, Hf, Ti, Al, Ca, Mg and Sr.

6. The method according to claim 1, wherein the Mo alloy contains 0.001 to 5 wt. % of one or more metals selected from the group consisting of Re, Ti, Zr, Hf, V, Ni, Co and Al.

7. The method according to claim 1, wherein the step of mechanically alloying in a high-energy grinding mill comprises treating the powder mixture in an attrition mill, a falling-ball mill, or a vibratory mill with process times from 0.5 to 48 hours.

8. The method according to claim 7, wherein the step of mechanically alloying is performed in a hydrogen atmosphere.

9. The method according to claim 1, which comprises cold compacting the mechanically alloyed powder before hot compacting.

10. The method according to claim 1, wherein the hot compacting step comprises pressure-aided hot compacting at a compacting temperature between 1200° C. and 1600° C.

11. The method according to claim 10, wherein the hot compacting step comprises hot isostatic pressing, sinter HIP, or powder extrusion.

12. The method according to claim 1, wherein the hot compacting step comprises pressure-free hot compacting at a compacting temperature between 1600° C. and 1900° C.

13. The method according to claim 1, wherein the step of superplastic forming is performed at a forming rate $\dot{\epsilon}$, where $1\times10^{-4}\ s^{-1}<\dot{\epsilon}\leqq1\times10^{-2}\ s^{-1}$.

14. The method according to claim 1, wherein the superplastic forming step comprises rolling or pressing.

15. The method according to claim 1, wherein the heat treating step comprises heat treating at a temperature between 1600° C. and 1900° C., in a reducing atmosphere or in vacuum.

16. The method according to claim 1, wherein the hot compacting step is substantially a pressureless hot compacting step.

17. The method according to claim 1, wherein the hot compacting step is substantially a pressure-aided hot compacting step.

* * * * *